US007018225B2

(12) United States Patent
Chen et al.

(10) Patent No.: US 7,018,225 B2
(45) Date of Patent: Mar. 28, 2006

(54) SOCKET CONNECTOR WITH ANTI-DISTORTION FUNCTIONS

(75) Inventors: A-Lu Chen, Tu-Chen (TW); Hsiu-Yuan Hsu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/934,849

(22) Filed: Sep. 3, 2004

(65) Prior Publication Data

US 2005/0048826 A1 Mar. 3, 2005

(30) Foreign Application Priority Data

Sep. 3, 2003 (TW) ..... 92124288 A

(51) Int. Cl.
*H01R 11/22* (2006.01)

(52) U.S. Cl. ..... 439/266

(58) Field of Classification Search ..... 439/266, 439/268, 259, 342, 264
See application file for complete search history.

(56) References Cited

U.S. PATENT DOCUMENTS

| | | | | |
|---|---|---|---|---|
| 5,186,642 | A | 2/1993 | Matsuoka et al. | |
| 5,213,531 | A * | 5/1993 | Matsuoka et al. | 439/331 |
| 5,669,780 | A * | 9/1997 | Fukunaga | 439/266 |
| 5,690,281 | A | 11/1997 | Ikeya et al. | |
| 6,045,382 | A * | 4/2000 | Tohyama et al. | 439/266 |
| 6,375,484 | B1 * | 4/2002 | Shimada | 439/330 |
| 6,477,051 | B1 * | 11/2002 | Barsun | 361/704 |
| 6,537,093 | B1 * | 3/2003 | Kanesashi et al. | 439/268 |
| 6,822,421 | B1 * | 11/2004 | Ogawa et al. | 320/107 |
| 6,827,599 | B1 * | 12/2004 | Gattuso et al. | 439/342 |

* cited by examiner

*Primary Examiner*—Gary Paumen
(74) *Attorney, Agent, or Firm*—Wei Te Chung

(57) ABSTRACT

Disclosed is a socket connector (1) for testing IC chips. The socket connector includes a base (10), a plate (20) moveably mounted on the base (10) and a cover (30) located above the plate. A pair of actuators (60) is respectively engaged with the base, the plate and the cover to transform a vertical movement of the cover relative to the base to a horizontal movement of the plate relative to the base. A first and a second auxiliary plate (80, 82) are engageably attached to the base and the cover, respectively. A number of springs is disposed between and engaged with the auxiliary plates so as to avoid distortion of the cover.

6 Claims, 3 Drawing Sheets

SOCKET CONNECTOR WITH ANTI-DISTORTION FUNCTIONS

BACKGROUND OF THE INVENTION

1. Field of the Invention

The present invention relates to socket connectors, especially to a socket connector with anti-distortion functions used for testing Integrated Circuit chips (hereinafter simple for IC chip).

2. Description of Related Art

A socket connector is widely used for IC chip test. A conventional socket connector comprises a base, a movable plate mounted on the base and a plurality of actuators for actuating the movable plate to move relative to the base. The movable plate is movable between a rest position and an operating position. Such socket connectors are disclosed in U.S. Pat. No. 5,186,642 and No. 5,690,281.

Referring to FIG. 3, a conventional socket connector 9 used for IC chip tests comprises a squared flat base 90, a movable plate 91 mounted on the base 90 and movable relative to the base 90, a cover 92, a plurality of springs 96, an auxiliary member 93 and a pair of actuators 95.

The movable plate 91 is a squared plan plate with a squared central portion cut away. The movable plate 91 comprises a plurality of first receiving holes 911 arranged in lines around the squared central portion for receiving pins of the IC chip. A pair of guiding portions 914 is formed at corner portions of a rear side of the movable plate 91. Each guiding portion 914 defines a first engaging hole 916.

The base 90 is a flat and plan plate, and defines a squared cutout at a central portion corresponding to the squared central portion of the movable plate 91. A plurality of second receiving holes 901 is defined through the base 90 corresponding to the first receiving holes 911. A pair of placing portions 903 is formed at opposite lateral sides adjacent to the front side. Four third receiving boles 9012 are defined at corner portions of the base 90.

The cover 92 is a frame and defines an opening 921 at a central portion thereof, thus the first receiving holes 911 of the movable plate 91 are upwardly exposed. A plurality of forth receiving holes (not shown) corresponding to the third receiving holes 9012 of the base 90 is defined on a lower surface of corner portions of the cover 92. A pair of positioning holes 924 is defines at each lateral side of the cover 92.

In assembly, the movable plate 91 are mounted on the base 90, with the first receiving holes 901 corresponding to the second receiving holes 911. The auxiliary member 93 is fixed with the cover 92 through fastening with the positioning holes 924. The actuators 95 are assembled with the corresponding auxiliary member 93 and respectively engaged with the first engaging hole 916 of the movable plate 91 and the placing portion 903 of the base 90. Four springs 96 are received in the third receiving holes 9012 and the forth receiving holes. In operation, an external force is exerted on the cover 92 end the cover 92 is pressed downwardly. The movable plate 91 is actuated from the rest position to the operating position. Because of reserve forces of the springs 96 exerted on corner portions of the cover 92, the cover 92 is easily distorted, which may lead to unreliable contact of the IC chip and the movable plate 91.

Hence, an improved socket connector is required to overcome the disadvantages of the prior art.

BRIEF SUMMARY OF THE INVENTION

An object of the present invention is to provide a new socket connector capable of avoiding distortions of a cover thereof.

A socket connector for testing IC chips includes a base, a plate moveably mounted on the base and a cover located above the plate. A pair of actuators is respectively engaged with the base, the plate and the cover to transform a vertical movement of the cover relative to the base to a horizontal movement of the plate relative to the base. A first and a second auxiliary plate are engageably attached to the base and the cover, respectively. A number of springs is disposed between and engaged with the auxiliary plates.

While an external force is exerted on the second auxiliary plate, the springs between the first auxiliary plate and the second auxiliary plate are resiliently distorted. There's not any reverse force of the springs exerted on the cover, thus, the cover may avoid a distortion.

Other objects, advantages and novel features of the invention will become more apparent from the following detailed description of a preferred embodiment when taken in conjunction with the accompanying drawings.

DETAILED DESCRIPTION OF THE PREFERRED EMBODIMENTS

Figure 1:
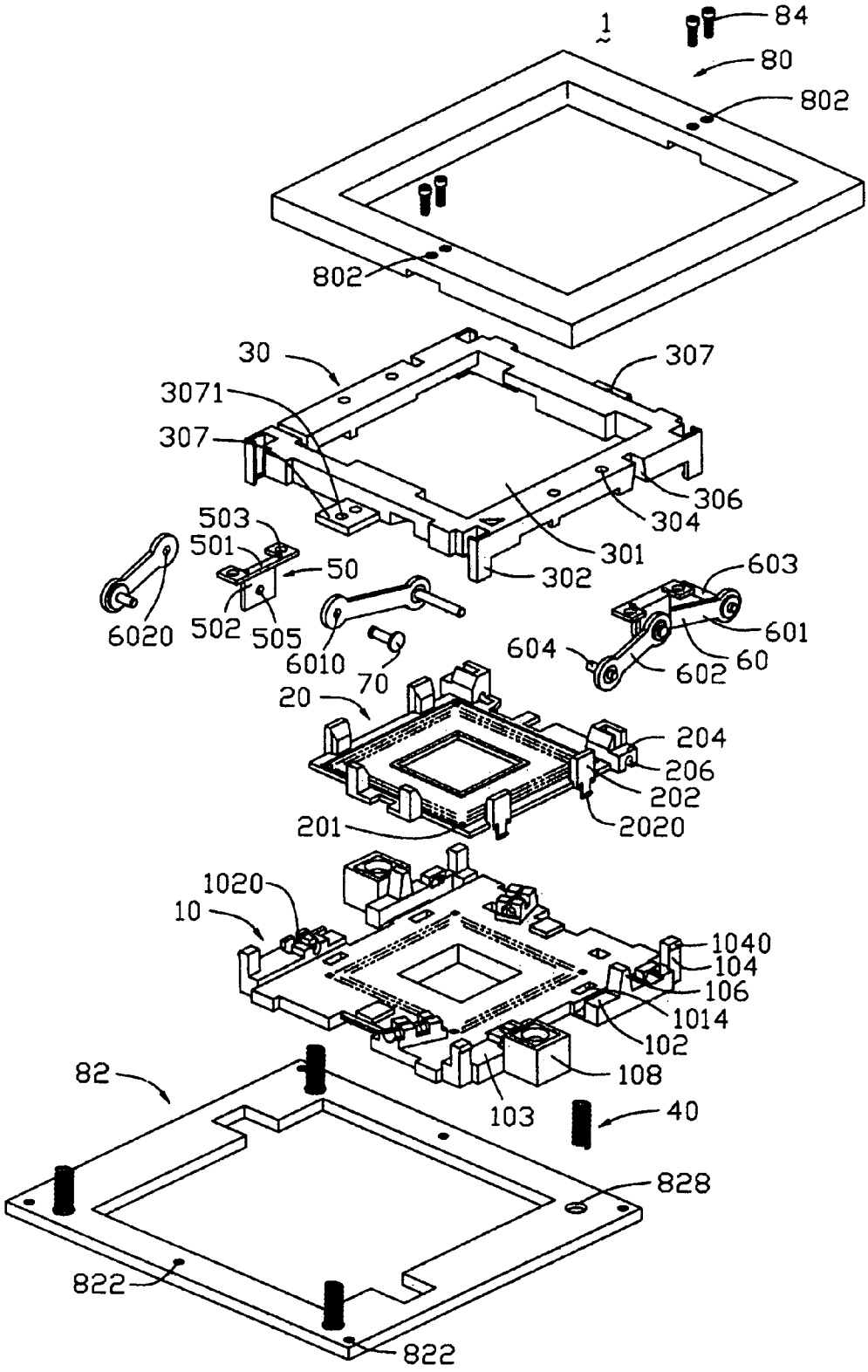
FIG. 1 is an exploded and perspective view of a socket connector in accordance with a preferred embodiment of the present invention.
Figure 2:
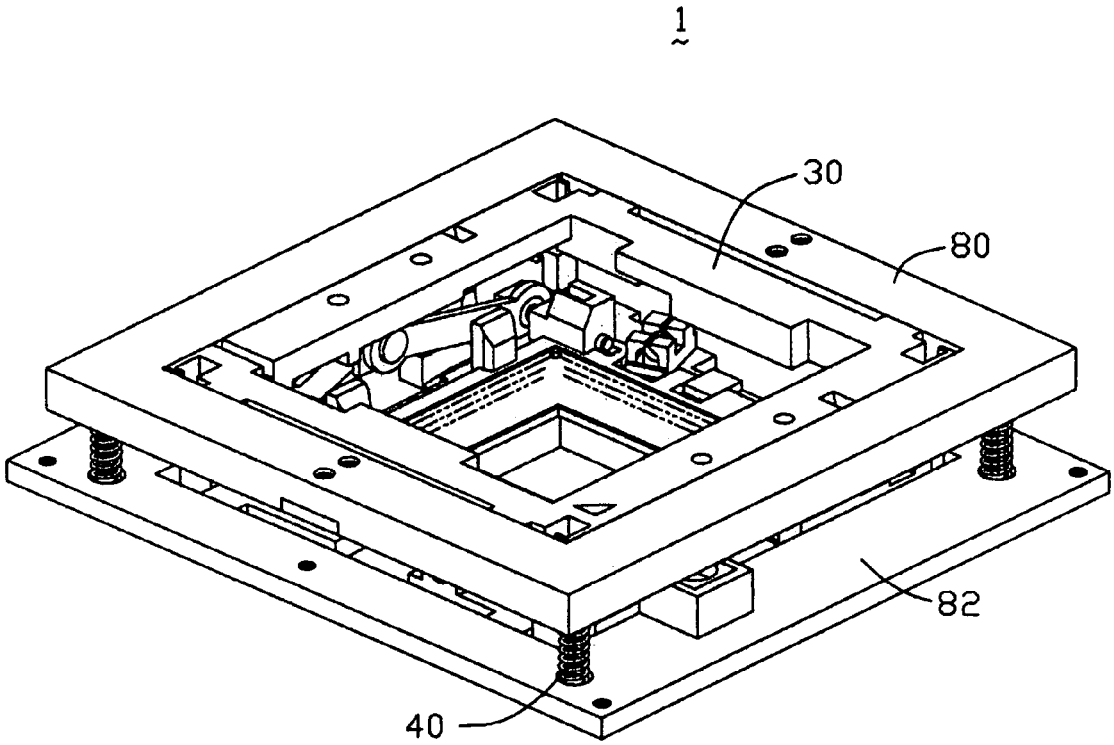
FIG. 2 is an assembled view of the socket connector of FIG. 1.
Figure 3:
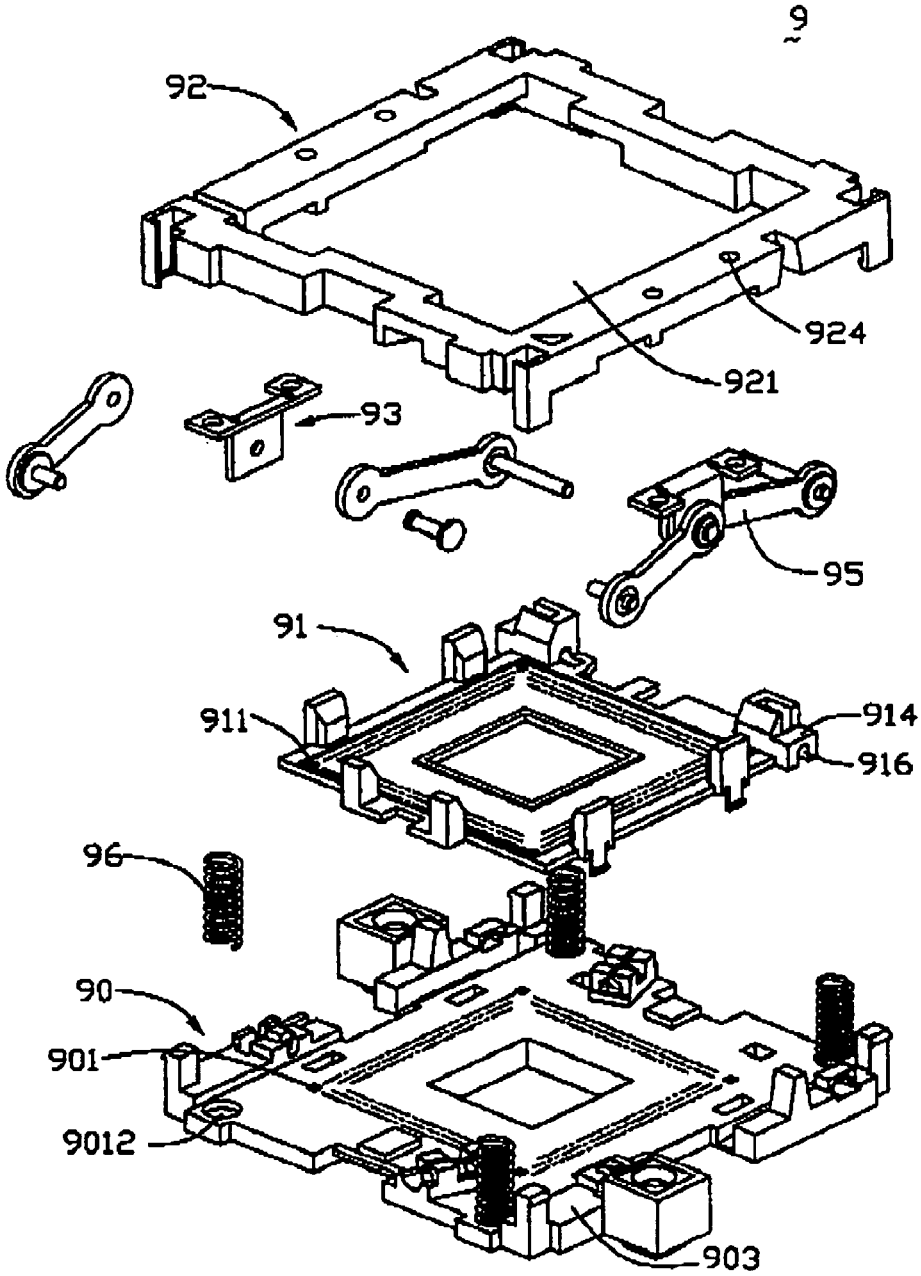
FIG. 3 (PRIOR ART)
FIG. 3 is an exploded and perspective view of a conventional socket connector.

Referring to FIGS. 1 and 2, a socket connector 1 in accordance with a preferred embodiment of the present invention is used for electrically interconnecting an IC chip (not shown) and a PCB (not shown). The socket connector 1 comprises a base 10, a movable plate 20 mounted on the base 10 and moveable relative to the base 10, a cover 30 mounted on the movable plate 20, a plurality of springs 40, a pair of auxiliary members 50, a pair of actuators 60 for actuating the movable plate 20 to move in a horizontal directions and a pair of auxiliary plates 80, 82.

The movable plate 20 is a squared plan plate with a squared central portion cut away. The movable plate 20 comprises a plurality of first receiving holes 201 arranged in lines around the squared central portion for receiving pins (not shown) of the IC chip therein. A pair of guiding portions 204 is formed at corner portions of a rear side of the movable plate 20. Each guiding portion 204 defines a first engaging hole 206. A plurality of locking portions 202 is formed at opposite lateral sides of the movable plate 20. A tab 2020 laterally extends from a lower end of one locking portion 202.

The base 10 has a flat and rectangular configuration, and defines a squared cutout corresponding to the squared central portion of the movable plate 20 at a central portion thereof. A plurality of second receiving hales 101 corresponding to the first receiving holes 201 is defined in the base 10. A pair of placing portions 103 is formed at opposite lateral sides of the base 10. Each placing portion 103 defines a first engaging trough 1020. A pair of lengthwise slits 1014 is symmetrically defined on the base 10. A pair of positioning portions 102 is respectively formed at lateral sides of the base 10. A projection 106 upwardly projects from each positioning portion 102. Four clasping portions 104 respectively and upwardly project from corner portions of the positioning portions 102 and the placing portions 103. Each clasping portion 104 forms a clasping end 1040 at a free end thereof.

The cover 30 defines an opening 301 at a central portion thereof, thus the movable plate 20 are upwardly exposed. A pair of first positioning holes 304 is defined at each lateral sides of the cover 30. A pair of recesses 306 corresponding to the projections 106 of the base 10 is defined at two lateral sides of the cover 30. The cover 30 also defines a plurality of second engaging troughs 302 corresponding to the clasping portions 104 of the base 10. A pair of engaging tabs 307 respectively and horizontally extends from a front side and a rear side of the cover 30 in opposite directions. The engaging tabs 307 each defines a pair of second engaging holes 3071 therethrough.

The auxiliary member 50 comprises a horizontal portion 501 and a vertical portion 502 extending downwardly from the horizontal portion 501. The horizontal portion 501 defines a pair of second positioning holes 503 corresponding to the first positioning holes 304. The vertical portion 502 defines a positioning hollow 505 thererthrough. The actuators 60 are engaged with the auxiliary members 50. The actuator 60 includes a first operating arm 601 and a second operating arm 602. The first operating arm 601 defines a first operating hollow 6010. The second operating arm 602 defines a second operating hollow 6020. A first bolt 70 bolts through the first operating hollow 6010, the second operating hollow 6020 and the positioning hollow 505, thereby securing the actuator 60 with the auxiliary member 50 and ensuring pivotal movements of the actuator 60. The first operating arm 601 has a first pole 603 laterally extending from a free end in a same direction as the horizontal portion 501 extends. The second operating arm 602 has a second pole 604 extending from a free end in a same direction as the first pole 603 extends.

The auxiliary plates comprise a first auxiliary plate 82 and a second auxiliary plate 80. The auxiliary plates substantially are squared frames. The first auxiliary plate 82 comprises a plurality of third positioning holes 822 defined through middle portions of opposite sides thereof. Four third receiving holes 828 are defined at corner portions of the first auxiliary plate to receive the springs 40. The second auxiliary plate 80 comprises a plurality of third engaging holes 802 corresponding to the second engaging holes 3071 defined on the engaging tabs 307. Four forth receiving holes (not shown) is defined at lower surface of the second auxiliary plate 80.

In assembly, the first auxiliary plate 82 is fixed by bolting the third positioning holes 822 with the PCB. The base 10 is mounted on the PCB and engaged with the first auxiliary plate 82. The movable plate 20 is mounted on the base 10. The locking portions 202 of the movable plate 20 is inserted through the slits 1014 and locked with the PCB. As the slits 1014 are wider than the locking portion 202 in longitudinal direction, the slits 1014 are able to guide longitudinal movements of the movable plate 20. The actuators 60 are respectively engaged with the auxiliary members 50. The first bolt 70 respectively bolts through the first operating hollow 6010 of the first operating arm 601, the second operating hollow 6020 of the second operating arm 602 and the positioning hollow 505 of the auxiliary member 501, thereby securing the actuator 60 with the auxiliary member 50 and ensuring pivotal movements of the actuator 60. The first poles 603 of the first operating arms 601 are engaged with the first engaging hole 206 of the movable plate 20, and the second poles 604 are engaged with the first engaging trough 1020. The auxiliary members 50 are secured with the cover 30 by bolting the first positioning holes 304 and the second positioning holes 503. The clasping portions 104 are engaged with the second engaging trough 302. The projections 106 are engaged with the recesses 306. The second auxiliary plate 80 is mounted on the cover 30. Second bolts 84 are inserted into the third engaging holes 802 and the second engaging holes 3071, thereby fixing the second auxiliary plate 80 with the cover 30. Each of the springs 40 is located between the first auxiliary plate 80 and the second auxiliary plate 82, with one end thereof being received in the third receiving hole 828 and the other end thereof being received in the forth receiving hole.

In normal, the movable plate 20 is at the rest position. In operation, an external force is exerted on the cover 30 via the second auxiliary plate 80. The cover 30 is pressed down which causes pivotal movements of the first operating arm 601 and the second operating arm 602 in opposite direction. Because the second operating arms 602 is engaged with base 10 which is fixed with the PCB, in the pivotal movements, the free ends of the first operating arms 601 move away and take the movable plate 20 to the operating position. When the external force is released, the cover 30 is raised under a reserve operating force of the springs 40, and the first operating arm 601 and the second operating arm 602 move toward each other. Therefore, the movable plate 20 is taken to the rest position.

It will be understood that the invention may be embodied in other specific forms without departing from the spirit or central characteristics thereof. The present examples and embodiments, therefore, are to be considered in all respects as illustrative and not restrictive, and the invention is not be limited to the details given herein.

We claim:

1. A socket connector comprising:

a base;

a plate mounted on the and being moveable along a horizontal direction between a rest position and an operating position;

a cover located above the pate and being moveable along a vertical direction perpendicular to the horizontal direction;

a pair of actuators respectively attached to the base, the plate and the cover for transforming a vertical movement of the cover relative to the base to a horizontal movement of the cover relative to the base between the rest position and the operating position;

a first auxiliary plate attached to the cover;

a second auxiliary plate attached to the base; and a plurality of springs disposed between and respectively engaged with the first auxiliary plate and the second auxiliary plate.

2. The socket connector as claimed in claim 1, wherein the actuators are secured with the cover by bolting.

3. The socket connector as claimed in claim 1, wherein the cover is secured with the second auxiliary plate by bolting.

4. The socket connector as claimed in claim 1, wherein the movable plate defines a plurality of receiving holes for receiving pins of an Interacted Circuit chip.

5. The socket connector as claimed in claim 1, wherein the movable plate forms a plurality of locking portions, the base defines a plurality of slits corresponding to the locking portions, and the locking portions respectively engage with the corresponding slits.

6. A socket connector comprising:

a base;

a plate mounted on the base and being moveable relative to the base along a front-to-back direction;

an actuator performing a movement along both the front-to-back direction and a vertical direction;

a cover located above the plate and vertically moveably engaged with the base;

said actuator respectively engaged with the base, the plate and the cover to transform a vertical movement of the cover relative to the base to a horizontal movement of the plate relative to the base;

a first auxiliary plate engageably located below the base, a second auxiliary plate engageably above the cover; and a plurality of springs between the auxiliary plates.

* * * * *